US007354255B1

(12) United States Patent
Lishanski et al.

(10) Patent No.: US 7,354,255 B1
(45) Date of Patent: Apr. 8, 2008

(54) PISTON VIBRATORY PUMP

(76) Inventors: Grigori Lishanski, 10112 W. Sharon La., Apt. 1, Milwaukee, WI (US) 53225; Oleg Lishanski, 747 Alsace Cir., Buffalo Grove, IL (US) 60089

( * ) Notice: Subject to any disclaimer, the term of this patent is extended or adjusted under 35 U.S.C. 154(b) by 367 days.

(21) Appl. No.: 11/063,677

(22) Filed: Feb. 23, 2005

(51) Int. Cl.
*F04B 7/04* (2006.01)

(52) U.S. Cl. ..... 417/491; 417/437; 417/439; 417/490; 417/255; 417/234; 222/146.5; 222/146.6; 222/333; 239/332

(58) Field of Classification Search ..... 222/146.5, 222/146.6; 239/332; 417/225, 437, 490, 417/234, 235, 255, 439, 491
See application file for complete search history.

(56) References Cited

U.S. PATENT DOCUMENTS 4,406,406 A * 9/1983 Knapp ..... 239/313
4,792,096 A * 12/1988 Gregory ..... 239/113
5,716,007 A * 2/1998 Nottingham et al. ..... 239/332

* cited by examiner

*Primary Examiner*—Devon C. Kramer
*Assistant Examiner*—Leonard J Weinstein
(74) *Attorney, Agent, or Firm*—Boyle Fredrickson, SC

(57) ABSTRACT

The present invention is an improved vibratory pumping mechanism that increases the efficiency of utilization of the vibratory motion within a mechanism. More specifically, the mechanism includes a central chamber within which a piston is oscillated to draw fluid into the chamber and expel fluid from within the chamber outwardly through a nozzle connected to the chamber. The chamber includes a pressure tube connected to a rearward end of the chamber and to a secondary chamber positioned around and in fluid communication with the chamber. The pressure tube allows the negative pressure generated by the motion of the piston in either direction to be utilized in preventing any fluid from being directed out of the mechanism in a direction other than through the nozzle, thereby increasing the efficiency of the pump.

22 Claims, 3 Drawing Sheets

PISTON VIBRATORY PUMP

FIELD OF THE INVENTION

The present invention is related to pumps, and more specifically to a pump capable of using a vibratory or oscillating motion in order to pump a fluid at a desired rate.

BACKGROUND OF THE INVENTION

With regard to the pumping of fluids, a wide range of fluid pumping devices have been developed in order to meet this need. However, with regard to certain situations, the prior art pumping mechanisms do not provide the range of pumping flow rates desired with a minimum of expense desired with such devices.

Thus, a number of vibratory pump mechanisms have been developed, which are disclosed in U.S. Pat. Nos. 6,315,533; 6,364,622; 6,428,289; and 6,604,920, and U.S. patent application Ser. No. 10/863,713, each of which are herein incorporated by reference in their entirety, in order to provide a pumping mechanism which provides the wide range of pumping rates with a low cost and adaptable mechanism. Nevertheless, it is desirable to further improve upon these vibratory pump mechanisms in order to increase their usefulness and efficiency over a wide range of potential uses.

SUMMARY OF THE INVENTION

According to a primary aspect of the present invention, an improved vibratory pumping mechanism is disclosed in which the mechanism includes a central chamber enclosing a piston therein. The piston can be oscillated within the chamber to selectively open and close a number of openings in the chamber in a manner in which draws fluid from a fluid reservoir into the chamber. The fluid drawn into the chamber can then be expelled from the chamber by further motion of the piston. In order to increase the efficiency of the mechanism in pumping the selected fluid, the chamber further includes a pipe or tube extending between and in fluid connection with the end of the chamber opposite an outlet end for the chamber, and the portion of the chamber approximately at the location where the openings in the chamber through which the fluid is entering the chamber are located. The tube serves to allow the pressure generated by the piston during motion in each direction to be utilized to more effectively draw fluid into or expel fluid out of the chamber. This is accomplished by allowing the pressure generated by the movement of the piston in both directions to be utilized in a manner which most effectively promotes the fluid being drawn into the chamber and/or the ejection of the fluid from the chamber through the outlet end.

According to another aspect of the present invention, the increased efficiency of the pump enables the improved pumping mechanism to be utilized more effectively in mixing various fluids prior to dispensing the mixed fluids from the chamber. The improved mechanism can be connected separately to reservoirs of each of the fluids to be mixed which can then be drawn into the chamber through the operation of the mechanism. The fluids are subsequently and thoroughly mixed within the chamber and expelled from the chamber by the continuous oscillating motion of the piston within the chamber.

According to still another aspect of the present invention, the chamber of the improved pumping mechanism can be formed with two sets of spaced openings through which the fluid can enter the chamber in order to enable the piston to cause fluid to enter the chamber through one of the sets of openings during movement of the piston in each direction. The increased fluid flow into the chamber, in connection with the presence of the tube connected to the spaced sections of the chamber allows for a significant increase in the volume of fluid which can be expelled from the chamber by the operation of the mechanism.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
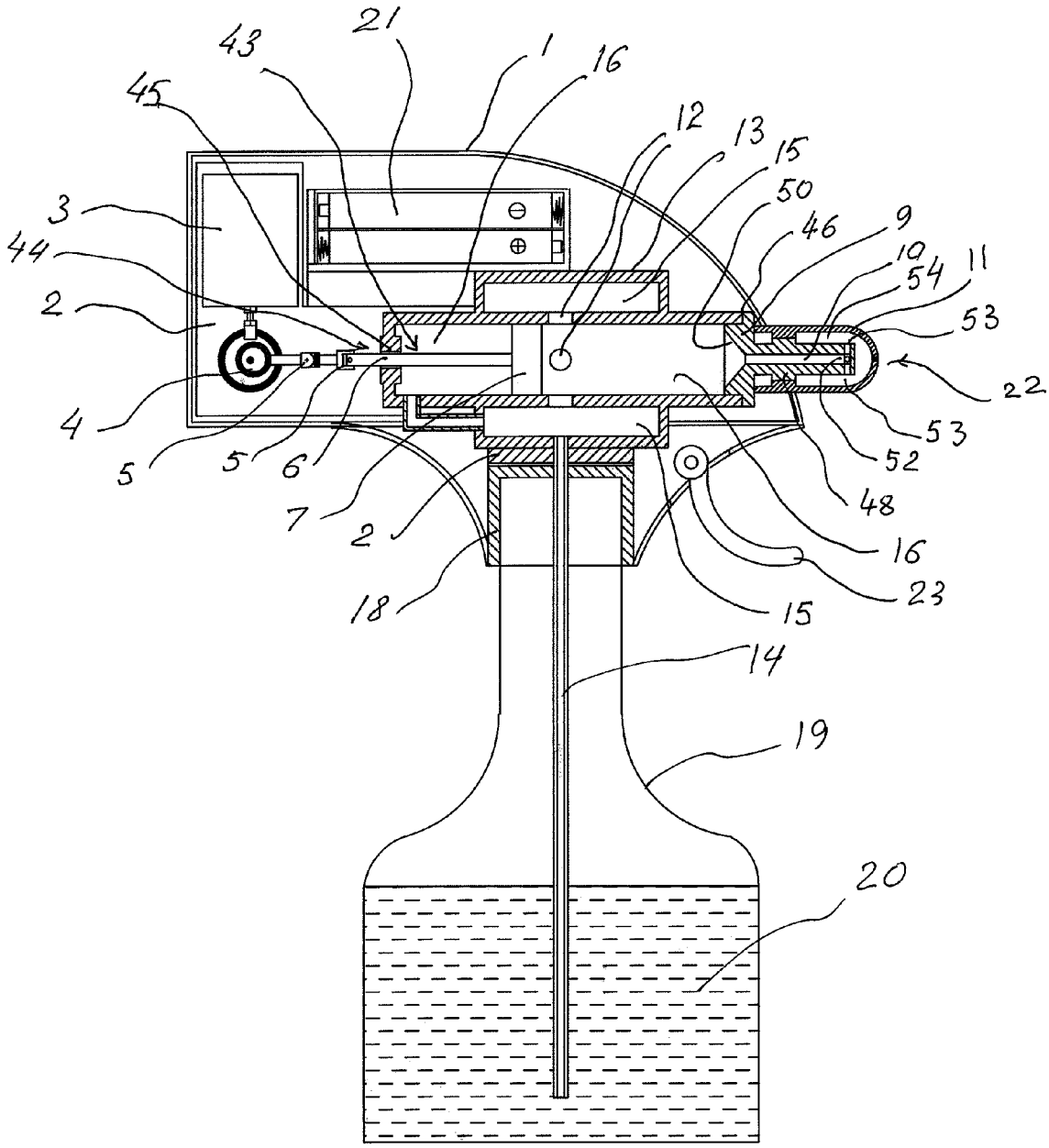
FIG. 1 is a cross-sectional view of a pumping mechanism constructed according to the present invention incorporated within a spray bottle.

With reference now to the drawing figures in which like reference numerals designate like parts throughout the disclosure, a pumping mechanism constructed according to the present invention is indicated generally at 2 in FIG. 1. The mechanism 2 is contained within a housing 1 that includes a coupling 18 releasably attachable to a fluid reservoir or bottle 19. The bottle 19 includes an amount of a fluid 20 that is to be dispensed by the mechanism 2. However, the housing 1 enclosing the mechanism 2 can take various forms, including those not directly connected to the reservoir as shown in the drawing figures.

The mechanism 2 includes a motor 3 operatively connected to a power supply 21, preferably formed by a pair of batteries, but can be any suitable power supply. The connection between the motor 3 and power supply 21 is controllable by a suitable switch, and preferably a manually operated handle 23 in order to enable the power supply 21 to operate the motor 3. When operated, the motor 3 in turn operates a suitable oscillating mechanism, and preferably a rotatable cam 4, that is connected opposite the motor 3 to a piston 7. The piston 7 is connected to one end of a rod 6 that extends opposite the piston 7 towards the oscillating mechanism 4 and that is connected to the mechanism 4 by a suitable mechanism, and preferably a pair of hinges 5 to allow the rod 6 to move in a generally linear manner when the rotating oscillating mechanism is operated.

The piston 7 and adjacent portion of the rod 6 are positioned within a cylinder 8 that forms the central body of the mechanism 2 and that has a cross-section complementary to that of the piston 7, which is preferably circular. The cylinder 8 includes a first end 44 defining an opening 45 therein through which the rod 6 extends. The first end 44 sealingly engages the rod 6 around the periphery of the opening 45 in order to provide a fluid tight seal between the rod 6 and he cylinder 8.

The cylinder 8 also includes a second end 46 to which is attached an outlet 9. The outlet 9 includes an inner member 48 secured to the second end 46 of the cylinder 8 and having an aperture 10 extending completely therethrough. The aperture 10 has a wide, and preferably conical inner end 50 and a narrow outer end 52 connected to a number of outlet holes 53. However, the particular shape of the aperture 10 can vary as desired. An outer member or nozzle 11 is secured around the inner member 48 to define a space 54 between the inner member 48 and nozzle 11. The space 54 is designed to receive an amount of fluid 20 exiting the inner member 48 through the outlet holes 53 for subsequent dispensing from the nozzle 11 through a number of apertures 22 located approximately in alignment with the aperture 10 and the inner member 48.

The spaces on each side of the piston 7 define a pair of portions within the cylinder 8, namely a rearward portion 43, and a forward portion 16. At the juncture of the respective portions 16 and 43, the cylinder 8 includes a number of apertures 12 that enable the interior of the cylinder 8 to be in fluid communication with the interior 15 of a chamber 13 positioned concentrically around the cylinder 8. The chamber 13 and cylinder 8 are each preferably formed of a fluid-impervious material, such as a plastic metal. A plastic material is preferred due to the ability to resist corrosion from the fluid 20. Also, the cylinder 8 and chamber 13 can be formed separately or integrally with one another. The chamber 13 includes a pipe 14 that extends radially outwardly from there from and that is positioned within the fluid 20 held within the bottle 19 for dispensing by the mechanism 2 and defines an interior 15 around the cylinder 8. The pipe 14 is also formed of a fluid-impervious material and can be formed integrally with or separately from the chamber 13.

The mechanism 2 also includes a pressure tube 17 connected between the rearward portion 43 adjacent the first end 44, and the chamber 13. The pressure tube 17 allows fluid communication between the rearward portion 43 and the interior 15 of the chamber 13.

In operation, when the switch 23 is depressed to actuate the mechanism 2, the motor 3 operates the oscillating mechanism 4 which serves to move the rod 6 and piston 7 in an oscillating manner within the cylinder 8. Movement of the piston 7 in a direction towards the rearward portion 43 exposes the apertures 12 and creates a negative fluid pressure within the forward portion 16. This negative fluid pressure results in the fluid 20 being drawn upwardly through the pipe 14, into the chamber 13 and subsequently into the cylinder 8 through the aperture 12. The presence of the pressure tube 17 enhances this flow of the fluid 20 into the chamber 8 by causing the high pressure generated in the rearward portion 43 by the rearward movement of the piston 7 to be directed through the pressure tube 17 into the chamber 13 thereby forcing additional fluid 20 through the apertures 12.

Conversely, when the piston 7 is moved toward the forward portion 16, the fluid 20 contained within the cylinder 8 is urged through the aperture 10 in the inner member 48 of outlet 9, thereby causing fluid 20 from the inner member 48 and from within the space 54 between the inner member 48 and the nozzle 11 to be dispensed through the apertures 22. Additionally, some of the fluid 20 is urged out of the cylinder 8 through the apertures 12 and into the chamber 13. Instead of flowing back through the tube 14 into the reservoir 19, the majority of this portion of the fluid 20 can is directed from the forward portion 16 of the cylinder 8 or chamber 13 through the pressure tube 17 into the rearward portion 43 due to the negative fluid pressure that is created in the rearward portion 43 by the forward movement of the piston 7.

Thus, during the oscillating movement of the piston 7, the use of the pressure tube 17 allows the negative fluid pressure created by the movement of the piston 7 in each direction to direct a portion of the fluid 20 between the rearward portion 43 and forward portion 16 of the cylinder 8, greatly reducing the amount of fluid 20 that is urged back into the reservoir 19 through the tube 14. This in turn results in a much more efficient pumping mechanism.

Figure 2:
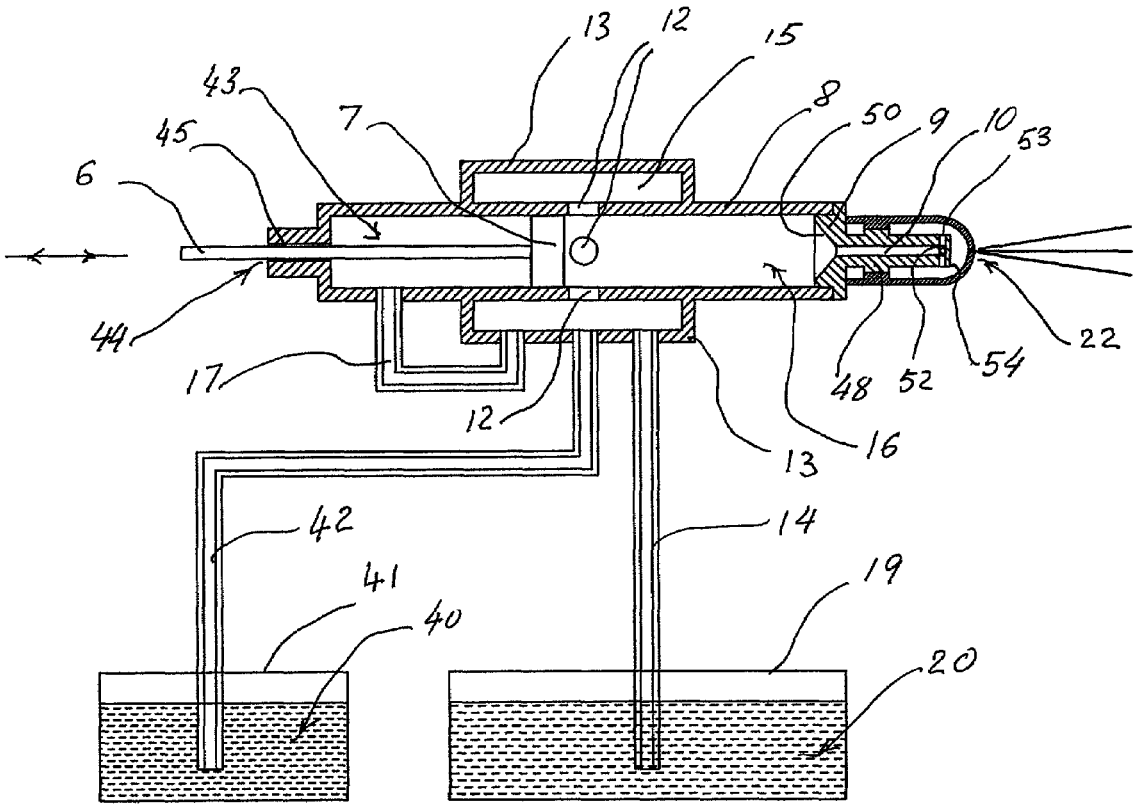
FIG. 2 is a cross-sectional view of a second embodiment of the pumping mechanism of FIG. 1 including a pair of fluid reservoirs connected to the mechanism.

Looking now at FIG. 2, in a second embodiment the pumping mechanism 2 of the present invention is modified to include a second pipe 42 that is connected between the chamber 13 and a second reservoir 41 holding a second fluid 40. During the operation of this embodiment of the mechanism 2, the fluids 20 and 40 held within the respective reservoirs 19 and 41 are simultaneously drawn into the chamber 13 and mixed within the chamber 13 and cylinder 8 prior to being dispensed from the mechanism 2 by the nozzle 11. Thus, the second embodiment of the mechanism 2 provides a simple and efficient way to mix a number of fluids with one another immediately prior to dispensing the fluids, in contrast to other more complicated systems in which the fluids must be mixed together prior to introduction into the respective pumping mechanism.

Figure 3:
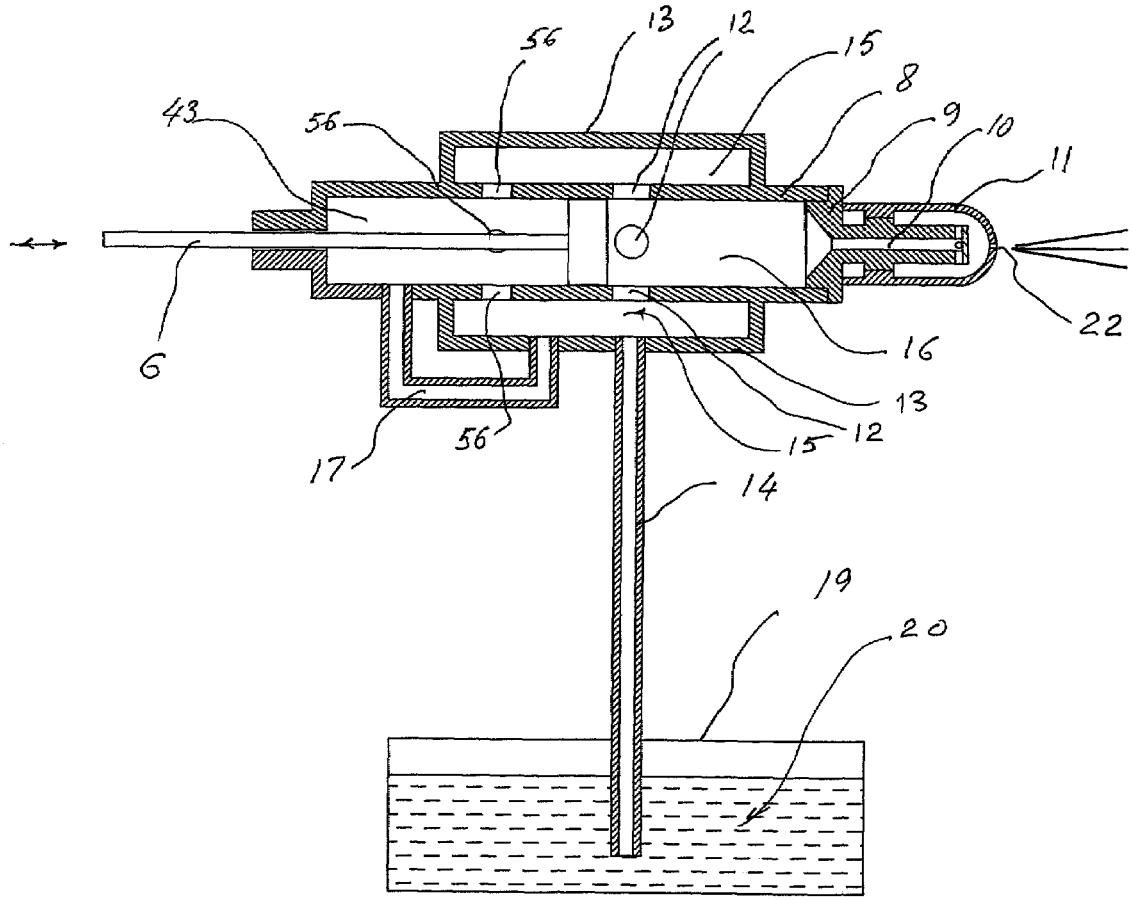
FIG. 3 is a cross-sectional view of a third embodiment of the mechanism of FIG. 1 including a pair of spaced sets of inlet openings within the mechanism.

Looking now at FIG. 3, a third embodiment of the pumping mechanism 2 is illustrated in which the cylinder 8 includes a second set of apertures 56 that are spaced towards the first end 44 of the cylinder 8 from the first set of apertures 12. The second set of apertures 56 functions identically to the first set of apertures 12 such that when the piston 7 is oscillating within the chamber 8, the fluid 20 is continually being drawn into the chamber 8 via either the apertures 12 or apertures 56. Also similarly to the previous embodiments, the pressure tube 17 allows for fluid contained within the rearward portion 43 or within the chamber 13 to move between the rearward portion 43 and chamber 13 in response to the negative fluid pressure caused by the oscillation of the piston 7 in order to maximize the volume of fluid 20 that can be drawn into and dispensed from the pumping mechanism 2.

Various alternatives are contemplated as being within the scope of the following claims particularly pointing out and distinctly claiming the subject matter regarded as the invention.

We claim:

1. A vibratory pump comprising:

a) a first chamber including an outlet end and at least one first aperture extending through the first chamber;

b) a second chamber at least partially surrounding the first chamber and positionable in fluid communication with a first fluid reservoir;

c) a pressure reduction tube that does not include a valve and is connected between the first chamber and an the second chamber;

d) a piston slidably disposed within the first chamber; and e) an oscillating mechanism operatively connected to the piston.

2. The pump of claim 1 wherein the pressure reduction tube is connected to the first chamber generally opposite the outlet end.

3. The vibratory pump of claim 1 wherein the second chamber includes a first pipe extending outwardly from the second chamber and insertable into the first fluid reservoir.

4. The vibratory pump of claim 3 wherein the second chamber includes a second pipe spaced from the first pipe and extending outwardly from the second chamber and insertable into a second reservoir.

5. A vibratory pump of claim 1 further comprising at least one second aperture extending through the first chamber and spaced from the at least one first aperture.

6. The vibratory pump of claim 1 wherein the oscillating mechanism comprises:

a) a power supply;

b) a motor operatively connected to the power supply; and c) an oscillating member operatively connected to the motor and to the piston.

7. The vibratory pump of claim 6 wherein the oscillating member comprises:

a) a rotating mechanism; and b) a rod connected between the rotating mechanism and the piston.

8. The vibratory pump of claim 6 wherein the power supply comprises at least one battery.

9. The vibratory pump of claim 1 further comprising a housing disposed around the first chamber, a second chamber, a pressure reduction tube and the oscillating mechanism.

10. The vibratory pump of claim 9 wherein the housing includes a coupling releasably connectable to the first fluid reservoir.

11. The vibratory pump of claim 9 wherein the housing includes a manually-operable switch operatively connected to the oscillating mechanism.

12. The vibratory pump of claim 1 wherein the outlet end comprises:

a) an inner member secured to the first chamber having a central opening extending therethrough; and b) an outer member secured to the inner member and defining a space therebetween, the outer member having at least one hole substantially in alignment with the central opening in the inner member.

13. The vibratory pump of claim 12 wherein the central opening includes a wide inner end.

14. The vibratory pump of claim 1 wherein the first chamber, the second chamber and a pressure tube are formed of a fluid-impervious material.

15. The vibratory pump of claim 14 wherein the first chamber, the second chamber and the pressure tube are formed of a plastic material.

16. The vibratory pump of claim 14 wherein the first chamber, the second chamber and the pressure tube are formed separately from one another.

17. A vibratory pump comprising:

a) a first chamber including an outlet end and at least one first aperture extending through the first chamber;

b) a second chamber at least partially surrounding the first chamber and including at least one pipe insertable into a fluid reservoir and extending outwardly from the second chamber;

c) a pressure reduction tube connected between an exterior surface of the first chamber generally opposite the outlet end and an exterior surface of the second chamber;

d) a piston slidably disposed within the first chamber; and e) an oscillating mechanism operatively connected to the piston.

18. The vibratory pump of claim 17 further comprising at least one second aperture extending through the first chamber and spaced from the at least one first aperture.

19. A method for pumping a fluid, the method comprising the steps of:

a) providing vibratory pump including a first chamber, including an outlet end and at least one first aperture extending through the first chamber, a second chamber at least partially surrounding the first chamber and positionable in fluid communication with an unpressurized first reservoir, and pressure reduction tube connected between an exterior surface of the first chamber and an exterior surface of the second chamber, a piston slidably disposed within the first chamber, and an oscillating mechanism operatively connected to the piston;

b) placing the second chamber in fluid communication with the unpressurized first fluid reservoir; and c) operating the pumping mechanism.

20. The method of claim 19 further comprising the step of placing the second chamber in fluid communication with a second unpressurized fluid reservoir prior to operating the pumping mechanism in order to mix fluids contained in the first reservoir and the second reservoir.

21. The method of claim 19 wherein the pumping mechanism further includes a manual switch, in a step operating the pumping mechanism comprises actuating the manual switch.

22. A vibratory pump comprising:

a) a first chamber including an outlet end and at least one first aperture extending through the first chamber;

b) a second chamber at least partially surrounding the first chamber and positionable in fluid communication with a first fluid reservoir;

c) a pressure reduction tube connected between the first chamber and the second chamber;

d) a piston slidably disposed within the first chamber; and e) an oscillating mechanism operatively connected to the piston, wherein the pump does not include any valves.

* * * * *